US010758032B2

(12) United States Patent
Kaye

(10) Patent No.: US 10,758,032 B2
(45) Date of Patent: Sep. 1, 2020

(54) TOOTHBRUSH AND TOOTHBRUSH HANDLE

(71) Applicant: LKDDSP LLC, Franklin Square, NY (US)

(72) Inventor: Lana Kaye, Franklin Square, NY (US)

(73) Assignee: LKDDSP LLC, Franklin Square, NY (US)

( * ) Notice: Subject to any disclaimer, the term of this patent is extended or adjusted under 35 U.S.C. 154(b) by 267 days.

(21) Appl. No.: 15/857,211

(22) Filed: Dec. 28, 2017

(65) Prior Publication Data

US 2019/0200741 A1 Jul. 4, 2019

(51) Int. Cl.
*A46B 5/02* (2006.01)
*A46B 9/04* (2006.01)

(52) U.S. Cl.
CPC ..... *A46B 5/021* (2013.01); *A46B 5/026* (2013.01); *A46B 9/04* (2013.01); *A46B 2200/1066* (2013.01)

(58) Field of Classification Search
CPC ..... A46B 5/021; A46B 5/026; A46B 9/04
USPC ..... D4/104, 110, 138
See application file for complete search history.

(56) References Cited

U.S. PATENT DOCUMENTS

D54,815 S * 4/1920 Ryan ..... D4/132
1,476,579 A 12/1923 Barnes
1,647,453 A 1/1927 Krantz
2,175,278 A 5/1937 Orebaugh
D104,904 S * 6/1937 Campbell ..... D4/132
2,668,308 A * 2/1954 Grossman ..... A46B 9/04 15/106
4,109,339 A 8/1978 Dietrich
4,150,457 A * 4/1979 Larson ..... A46B 5/0016 15/106
4,457,039 A 7/1984 Massari
4,502,177 A 3/1985 Beggs
4,672,706 A 6/1987 Hill
4,763,375 A 8/1988 Vieten
4,800,608 A 1/1989 Key
5,138,737 A * 8/1992 Thomas ..... A46B 5/02 15/143.1
D351,732 S 10/1994 Dair et al.
5,371,915 A 12/1994 Key
5,511,277 A 4/1996 Simonds
5,517,712 A * 5/1996 Schiano ..... A46B 5/00 132/309
5,517,713 A 5/1996 Hadcock
5,623,739 A 4/1997 Thompson
5,628,082 A 5/1997 Moskovich
D389,319 S * 1/1998 Gelinas ..... D4/132
(Continued)

*Primary Examiner* — Randall E Chin
(74) *Attorney, Agent, or Firm* — Gaspare J. Randazzo; Tutunjian & Bitetto, P.C.

(57) ABSTRACT

A toothbrush that includes a handle having a grip constraining portion which prevents users from gripping the toothbrush along a grip constraining region when they are brushing their teeth. The toothbrush is configured to induce the user to hold the toothbrush on a gripping portion in a specific grip. An angled extending length is positioned adjacent to the gripping portion and extends to the head of the toothbrush. When the user holds the toothbrush at the gripping portion, the angled extending length is configured so that the bristles on the brush head extend onto the user's gums at a desired angle, such as a 45° angle.

20 Claims, 2 Drawing Sheets

(56) References Cited

U.S. PATENT DOCUMENTS

| | | | | |
|---|---|---|---|---|
| D397,873 | S | 9/1998 | Lecce | |
| 5,979,005 | A | 11/1999 | Lecce | |
| 6,070,286 | A | 6/2000 | Cardarelli | |
| 6,131,231 | A * | 10/2000 | Huang | A46B 5/02 15/105 |
| 6,353,959 | B1 * | 3/2002 | Thomas, V | A46B 5/02 15/143.1 |
| 9,609,940 | B2 * | 4/2017 | Corbett | A46B 9/04 |
| 2003/0088933 | A1 | 5/2003 | Woods et al. | |
| 2009/0113650 | A1 | 5/2009 | Flek, Jr. et al. | |

* cited by examiner

TOOTHBRUSH AND TOOTHBRUSH HANDLE

BACKGROUND

1. Technical Field

The present principles generally relates to dental instruments and, more particularly, it relates to toothbrushes and toothbrush handles.

2. Description of Related Art

Toothbrushes are common oral hygiene devices that are used for cleaning the teeth and gums of the user. Toothbrushes typically include a head having bristles for cleaning the teeth and gums and a handle which permits the user to manipulate the toothbrush inside the user's mouth.

While a toothbrush provides improved oral hygiene, a toothbrush is less effective at cleaning the teeth and gums at certain angles. For example, the Bass technique and modified Bass technique have been determined to provide the most effective cleaning. These techniques require the user to hold the toothbrush so that it extends approximately 45 degrees onto the gum line of the user. Known prior art toothbrushes require significant skill and fine motor control by the user to hold the toothbrush at a 45 degree angle while brushing his/her teeth.

Known toothbrushes have handles which permit the user to grip the toothbrush in many different regions. This increases the number of orientations that the user may hold the toothbrush and increases the complexity with respect to extending the toothbrush a desired angle onto the user's gums and teeth and to maintain that angle during the brushing.

Accordingly, it is an aspect of the invention to provide a toothbrush or toothbrush handle that is configured to provide a 45 degree angle with respect to the user's gum line and/or teeth.

It is another aspect of the invention to provide a toothbrush or toothbrush handle that prevents the user from holding the toothbrush in certain regions and induces the user to hold the toothbrush on a gripping portion.

It is a further aspect of the invention to provide a toothbrush and toothbrush handle that is cost effective to manufacture.

SUMMARY OF THE INVENTION

In accordance with the present principles, a toothbrush is provided. The toothbrush includes a head positioned on a distal end of the toothbrush. The head includes a plurality of bristles connected thereto. A handle is secured to the head. The handle includes a grip constraining portion positioned on a proximal end of the handle. The grip constraining portion has dimensions that are configured to define a grip constraining region. The dimensions of the grip constraining portion are configured to prevent a user from gripping the toothbrush along the grip constraining region when the user uses the toothbrush. A gripping portion is positioned adjacent a distal end of the grip constraining portion. An angled extending length is positioned adjacent a distal end of the gripping portion. The angled extending length has a curved portion which is configured so that the head of the toothbrush extends onto the gum line of the user at a desired angle.

In another embodiment, a toothbrush handle for attaching to a head of a toothbrush having a plurality of bristles connected thereto is provided. The toothbrush handle includes a grip constraining portion positioned on a proximal end of the handle. The grip constraining portion has dimensions that are configured to define a grip constraining region. The dimensions of the grip constraining portion are configured to prevent a user from gripping the toothbrush along the grip constraining region when the user uses the toothbrush. A gripping portion is positioned adjacent a distal end of the grip constraining portion. An angled extending length is positioned adjacent a distal end of the gripping portion. The angled extending length has a curved portion which is configured so that the head of the toothbrush extends onto a gum line of the user at a desired angle.

BRIEF DESCRIPTION OF THE DRAWINGS

The features and advantages of the present invention will be more readily, understood from a detailed description of the exemplary embodiments taken in conjunction with the following figures. Referring now to the drawings in which like numerals represent the same or similar elements.

DETAILED DESCRIPTION

In accordance with the present principles, a toothbrush and toothbrush handle is provided. The toothbrush is configured to induce the user to hold the toothbrush on a gripping portion of the toothbrush handle with a particular grip when brushing his/her teeth and to restrict the user from gripping the toothbrush handle in a grip constraining portion. An angled extending length is positioned adjacent to the gripping portion and extends the toothbrush handle to the head of the toothbrush. When the user holds the toothbrush at the gripping portion, the configuration of the angled extending length with respect to the gripping portion provides a 45 degree angle of the toothbrush head and the bristles thereon onto the user's gums. Therefore, the toothbrush permits the user to easily position the toothbrush at a 45 degree angle with respect to the user's gum line.

Figure 1:
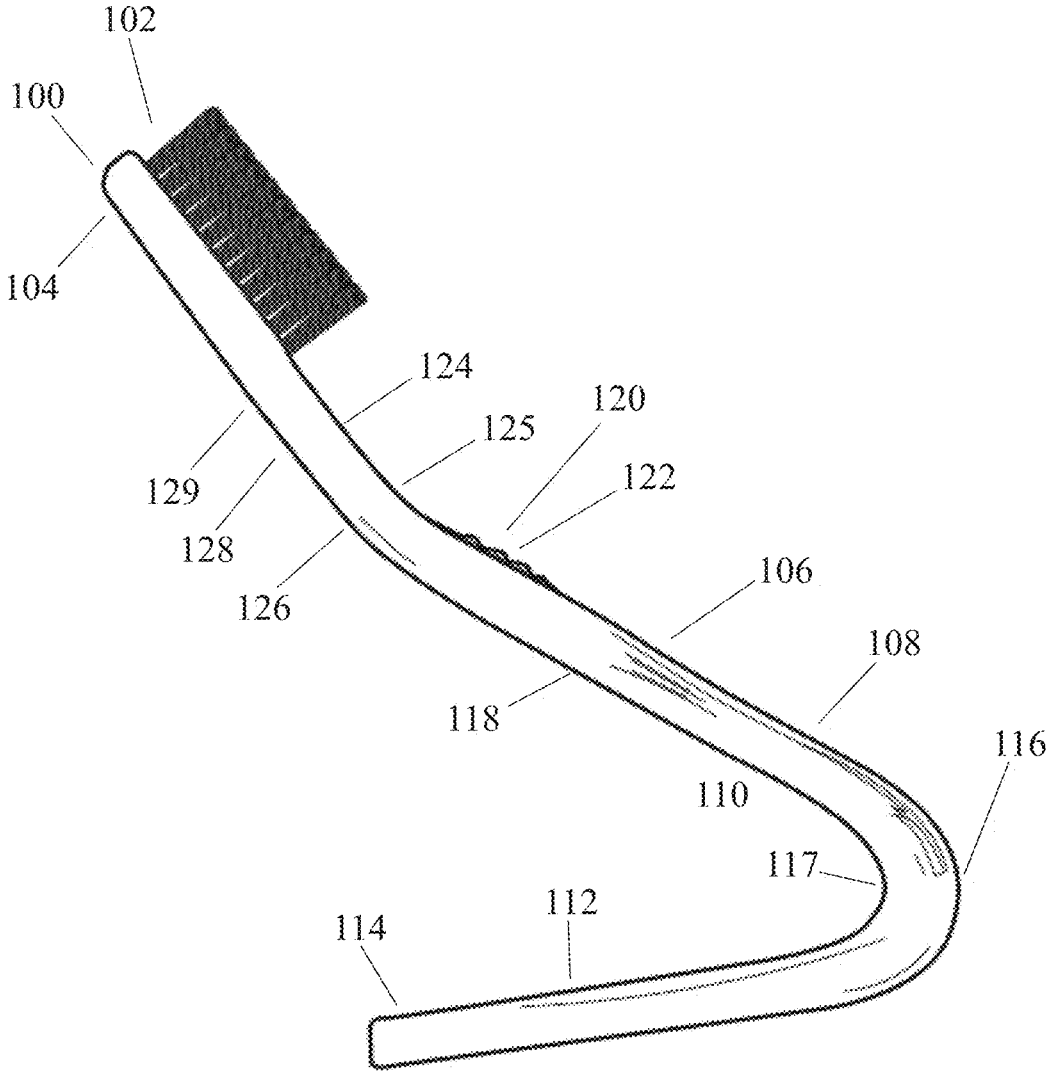
FIG. 1 shows a side elevational view of the toothbrush and toothbrush handle of the present invention.
Figure 2:
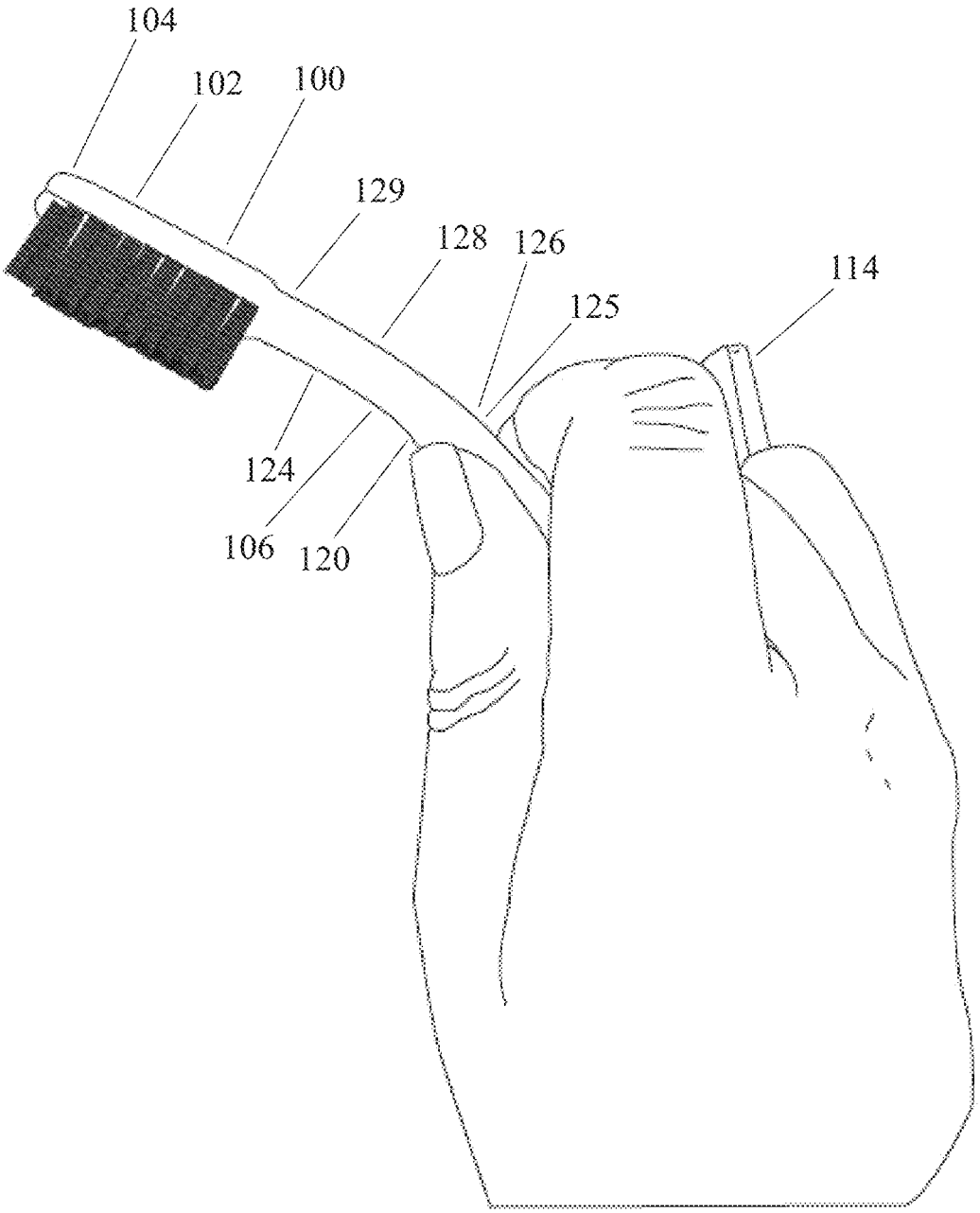
FIG. 2 shows a perspective view of a user gripping the toothbrush and toothbrush handle at the gripping region.

As shown in FIGS. 1-2, the toothbrush 100 includes a head 102 that is positioned on a distal end 104 of the toothbrush. In some embodiments, the head 102 may be removably attached to the toothbrush handle 106. However, the head 102 may be integral with the handle 106 as shown in the embodiment of FIG. 1.

The toothbrush handle 106 includes a grip constraining portion 108 which defines a grip constraining region (also interchangeably referred to as "grip encapsulating portion") 110. The grip constraining portion 108 is configured to prevent a user from gripping the toothbrush along the grip constraining region 110. In the embodiment shown in FIG. 1, the grip constraining portion 108 comprises a first constraining length 112 which extends from the proximal end 114 of the toothbrush handle to an angled connection portion 116. In one embodiment, the length of the first constraining length 112 may be between 1.75-3.25 inches. In a preferred embodiment, the length of the first constraining length 112 is approximately 2.5 inches.

The angled connection portion 116 has a curved surface preferably having an arc 117 of between 100° and 150°. In a preferred embodiment, the arc 117 of the angled connection portion 116 is approximately 125°.

The grip constraining portion 108 further comprises a second constraining length 118 which extends from the angled connection portion 116 to a gripping portion 120. The angled connecting portion 116 connects the first constraining length 112 to a second constraining length 118. In one embodiment, the first constraining length 112 and the second constraining length 118 are substantially planar and the grip constraining portion 108 is generally V-shaped. In one embodiment, the length of the second constraining length 118 may be between 1.75-3.25 inches. In a preferred embodiment, the length of the second constraining length 118 is approximately 2.5 inches.

The dimensions of the grip constraining portion 108 make it very difficult and cumbersome for users to hold the toothbrush handle 106 in the grip constraining region 110 and be able to efficiently and effectively manipulate the toothbrush while brushing their teeth. For example, if users naturally grip the toothbrush along the first constraining length 112, the toothbrush head extends away from the user's mouth and would require a large degree of wrist/arm bending and dexterity to direct the toothbrush into the user's mouth. This position is physically uncomfortable for the users and presents a considerable challenge for the users to be able manipulate the toothbrush properly while brushing their teeth. Therefore, the features of the first constraining length 112 will prevent users from holding the toothbrush at the first constraining length when brushing their teeth.

If the user gripped the toothbrush handle 106 on the second constraining length 118, the first constraining length 112 would extend into the user's hand and make it very difficult and cumbersome to hold the toothbrush and manipulate the toothbrush properly during a cleaning regimen. Therefore, the features of the second constraining length 118 will prevent users from holding the toothbrush at the second constraining length when brushing their teeth.

While the grip constraining portion 108 is shown having a first constraining length 112 and second constraining length 118 which forms a generally V-shaped grip constraining portion 108, the grip constraining portion may be a variety of other shapes, such as spherical shapes, rectilinear shapes, combinations thereof, etc., which are configured to prevent the user from comfortably gripping toothbrush at that region and efficiently manipulating the toothbrush during a cleaning.

As shown in FIG. 2, the configuration of the toothbrush 100 including the grip constraining portion 108 induces the user to grip the toothbrush on a gripping portion 120 adjacent the grip constraining region 110. The gripping portion 120 may have a generally rectilinear surface with rounded corners. In one embodiment, the gripping portion 120 also includes raised portions 122, such as raised ridges, for improved gripping of the toothbrush handle 106 at the gripping portion 120 by the user. The gripping portion 120 preferably has dimensions which permit the user to comfortably, hold the toothbrush handle 106 between the user's thumb and pointer finger. This natural grip at the gripping portion 120 provides improved control of the toothbrush to the user.

An angled extending length 124 is positioned adjacent the gripping portion 120. The angled extending length 124 preferably has a curved portion 125 at a proximal end 126. The curved portion 125 preferably has an arc of between 5° and 35° with respect to the gripping portion. In a preferred embodiment, the curved portion 125 has an arc of 20°.

The angled extending length 124 also includes a distal length 128. As shown in FIGS. 1-2, the distal length 128 may be substantially planar. The distal length 128 extends to the head 102 of the toothbrush and is connected to the head on a distal end 129 of the distal length. In one embodiment, the length of the angled extending length may be between 0.5-2 inches. In a preferred embodiment, the length of the angled extending length 112 is approximately 1 inch.

As the user naturally holds the toothbrush at the gripping portion 120 with the toothbrush handle between his/her thumb and pointer finger, the angle of the angled extending length 124 with respect to the gripping portion 120 of the toothbrush handle provides a 45° angle on the gums of the user as the user manipulates the brush onto the gums. When the user naturally brushes his/her teeth and extends the bristles on the toothbrush head to the gum line of the user, the toothbrush provides the desired 45° angle on the user's gum line without require any special dexterity or skill.

While the toothbrush 100 has been described as providing a 45° angle on the gums of the user, in other embodiments, the positioning and surface dimensions of the gripping portion 120 in combination with the angle of the angled extending length 124 may provide another angle on the user's gums, such as an angle between 30°-60°.

The present invention is also directed to a toothbrush handle 106 as described above with respect to the toothbrush. The toothbrush handle 106 may be integral with the toothbrush head 102 or may have an attachment mechanism on a distal end for attachment to a toothbrush head 102.

The toothbrush handle 106 may be fabricated from any relatively rigid material known in the art including a thermoplastic resin, metal or other materials known in the art that are not substantially bendable by hand and which permit the toothbrush handle 106 to substantially retain its shape during usage of the toothbrush handle by the user. In a preferred embodiment, the toothbrush handle 106 is fabricated from a rigid material that prevents any change of the shape of the toothbrush when used by the user.

It should be understood, of course, that the specific form of the invention herein illustrated and described is intended to be representative only, as certain changes may be made therein without departing from the clear teachings of the disclosure.

Although the illustrative embodiments have been described herein with reference to the accompanying drawings, it is to be understood that the present principles is not limited to those precise embodiments, and that various changes and modifications may be effected therein by one of ordinary skill in the pertinent art without departing from the scope or spirit of the present principles. All such changes and modifications are intended to be included within the scope of the present principles as set forth in the appended claims.

What is claimed is:

1. A toothbrush, comprising:

a head positioned on a distal end of the toothbrush, said head having a plurality of bristles connected thereto;

a handle secured to said head, said handle including:

a grip encapsulating portion positioned on a proximal end of the handle, said grip encapsulating portion having dimensions configured to form an arc having an open portion, the arc defining a partially open grip encapsulating region, said dimensions of the partially open grip encapsulating region being configured to only partially encapsulate at least some non-thumb fingers of a user when the user uses the toothbrush;

a thumb gripping portion positioned in line and below the head; and an angled extending length positioned adjacent a distal end of the gripping portion, said angled extending length having a curved portion which is configured so that the head of the toothbrush extends onto a gum line of the user at a desired angle.

2. The toothbrush as recited in claim 1, wherein the grip encapsulating portion comprises:

a first encapsulating length that extends from a proximal end of the handle to an angled connection portion;

the angled connection portion connects the first encapsulating length to a second encapsulating length, said angled connecting portion having a curved portion with the arc of approximately 100°-150°; and the second encapsulating length extends from the angled connecting portion to the gripping portion.

3. The toothbrush as recited in claim 2, wherein the first encapsulating length has a length of between 1.75-3.25 inches and the second encapsulating length has a length between 1.75-3.25 inches.

4. The toothbrush as recited in claim 2 wherein the first encapsulating length and second encapsulating length are relatively planar and the grip constraining portion is substantially V-shaped.

5. The toothbrush as recited in claim 2, wherein the angled connection portion has a curved portion with an arc of approximately 125°.

6. The toothbrush as recited in claim 1, wherein the gripping portion has dimensions which are configured to permit the user to securely hold the toothbrush handle between the user's thumb and pointer finger.

7. The toothbrush as recited in claim 6, wherein a distal length has a length between 0.5-2 inches.

8. The toothbrush as recited in claim 1, wherein the angled extending length comprises:

a curved portion at a proximal end having an arc between 5° and 35°; and a distal length which extends to the head of the toothbrush.

9. The toothbrush as recited in claim 8, wherein the curved portion of the angled extending length has an arc of approximately 20°.

10. The toothbrush as recited in claim 8, wherein the angled extending length is configured to extend the head of the toothbrush 45° onto the gum line of the user when the user holds the toothbrush at the gripping portion.

11. A toothbrush handle for attaching to a head of a toothbrush having a plurality of bristles connected thereto, comprising:

a grip encapsulating portion positioned on a proximal end of the handle, said grip encapsulating portion having dimensions configured to define a partially open grip encapsulating region formed from an arc having an open portion, said dimensions of the partially open grip encapsulating region being configured to only partially encapsulate at least some non-thumb fingers of a user when the user uses the toothbrush;

a thumb gripping portion positioned in line and below the head; and an angled extending length positioned adjacent a distal end of the gripping portion, said angled extending length having a curved portion which is configured so that the head of the toothbrush extends onto a gum line of the user at a desired angle.

12. The toothbrush handle as recited in claim 11, wherein the grip constraining portion comprises:

a first encapsulating length that extends from a proximal end of the handle to an angled connection portion;

the angled connection portion connects the first encapsulating length to a second encapsulating length, said angled connecting portion having a curved portion with the arc of approximately 100°-150°; and the second encapsulating length extends from the angled connecting portion to the gripping portion.

13. The toothbrush handle as recited in claim 12 wherein the first encapsulating length and second encapsulating length are relatively planar and the grip constraining portion is substantially V-shaped.

14. The toothbrush handle as recited in claim 11, wherein the first encapsulating length has a length of between 1.75-3.25 inches and the second encapsulating length has a length between 1.75-3.25 inches.

15. The toothbrush handle as recited in claim 11, wherein the gripping portion has dimensions which are configured to permit the user to securely hold the toothbrush handle between the user's thumb and pointer finger.

16. The toothbrush handle as recited in claim 11, wherein the angled extending length comprises:

a curved portion at a proximal end having an arc between 5° and 35°; and a distal length which extends to the head of the toothbrush.

17. The toothbrush handle as recited in claim 16, wherein the curved portion of the angled extending length has an arc of approximately 20°.

18. The toothbrush handle as recited in claim 16, wherein distal length has a length between 0.5-2 inches.

19. The toothbrush handle as recited in claim 11, wherein the angled extending length is configured to extend the head of the toothbrush 45° onto a gum line of the user when the user connects a toothbrush head to the toothbrush handle and holds the toothbrush handle at the gripping portion.

20. The toothbrush handle as recited in claim 11, wherein the angled connection portion has a curved portion with an arc of approximately 125°.

* * * * *